United States Patent [19]

Dijk et al.

[11] 4,187,132

[45] Feb. 5, 1980

[54] METHOD FOR TRANSVERSELY CUTTING AND HEMMING A WEB OF FABRIC

[75] Inventors: Jan A. Dijk, Winterswijk; Everhardus J. Hegeman, Wierden, both of Netherlands

[73] Assignee: B. V. Weverij Voorheen J. H. Meijerink & Zonen, Winterswijk, Netherlands

[21] Appl. No.: 846,077

[22] Filed: Oct. 27, 1977

[30] Foreign Application Priority Data

Oct. 27, 1976 [NL] Netherlands ..... 7611918

[51] Int. Cl.[2] ..... B32B 31/18; D03D 47/50

[52] U.S. Cl. ..... 156/88; 26/51.4; 26/51.5; 83/209; 156/250; 156/350; 156/353; 156/523; 226/10; 226/45

[58] Field of Search ..... 156/88, 250, 350, 353, 156/523; 26/51.4, 51.5, 53; 226/10, 45; 83/209, 212, 467 R

[56] References Cited

U.S. PATENT DOCUMENTS

| | | | |
|---|---|---|---|
| 2,716,266 | 8/1955 | MacIssac et al. | 226/10 |
| 3,755,033 | 8/1973 | Femus | 156/88 |
| 3,797,348 | 3/1974 | Moore | 83/209 |
| 3,856,599 | 12/1974 | Bylund | 156/88 |
| 4,120,740 | 10/1978 | Morgan et al. | 156/523 |

FOREIGN PATENT DOCUMENTS

| | | |
|---|---|---|
| 2165129 | 12/1973 | France . |
| 6502621 | 9/1965 | Netherlands . |
| 1249902 | 10/1971 | United Kingdom . |

*Primary Examiner*—Caleb Weston

*Attorney, Agent, or Firm*—Sughrue, Rothwell, Mion, Zinn & Macpeak

[57] ABSTRACT

A web of towel material having pile sections separated by narrow transverse strips of unpiled or plain cloth is fed onto an input table 4 of a cutting and hemming machine beneath a row of individually controlled drive rollers 5. When a plain transverse strip arrives in the area of a hinged table section 6 beneath a transverse bridge 2, its reduced thickness is detected by sensors 21 which individually disengage and brake an associated drive roller 5, to thereby stop the web with the strip accurately transversely aligned in the machine. The sensors and hinged table section are then swung out of the way, and a carriage 3 travel mounted on the bridge 2 is moved across the table. As it goes across it lays a weld strip 33 over the plain towel strip, heat softens the weld strip at 36, 37, cuts the towel and weld strip longitudinally with scissors 38, turns and folds the cut edges of the towel up and back over each other with the weld strip half inbetween with V-shaped ramp 41 and fold rods 42, 43, and seals the hem together with ultrasonic welder 46 and pressure roller 47.Tension is maintained on the web by a brush withdrawal roller 9 driven faster than drive rollers 5, and by clamping strips 61, 62.

3 Claims, 4 Drawing Figures

METHOD FOR TRANSVERSELY CUTTING AND HEMMING A WEB OF FABRIC

This invention relates to a method for transversely cutting and hemming a web of fabric, said web being moved along in longitudinal direction and by scanning the region where the web must be cut through with the aid of a number of scanners disposed along a line perpendicular to the direction of movement of the web, said web is being stopped each time automatically in that each scanner interrupts the drive of the corresponding part of the web's width and, finally, the web is set in motion again.

A method and device of this kind are known from U.S. Pat. No. 2,716,266. Towel material is moved along a table and scanned by scanners distributed across the width of the table. Each scanner operates a brake and all brakes are embodied such that they hold the web of fabric until all parts scanned across the width are in one line transversely to the web of fabric. The cloth is then rolled up or is being fed to a cutting device (not described further) for cutting off the towels from the web of fabric. The towels will then have to be hemmed. Since the web of fabric, after having been scanned and directed in transverse direction, is carried along for the next process, there is a possibility that the web is no longer directed. In addition, the consecutive positioning of the various processing devices requires a lot of space and accurate range setting of the elements with respect to each other.

It is the object of this invention to improve the known method such that the aforementioned drawbacks are overcome.

In accordance with the invention, said object is achieved in that in transverse direction of the web being arrested along said line cutting and hemming elements are being moved along for cutting the web and for hemming the edges which have been cut. In doing so, the conveyance of the products from one area of processing to the other is left out, since all operations are performed in the same area. Automatic control of the feed of the web makes it possible that the web is being stopped accurately in the line of processing and since the web is not being displaced between the various processes, renewed directing of the web between the separate processing stages is no longer required. Since the products are no longer guided along the hemming elements and said hemming elements are moved along the stationary web no longer displaced, an accurate, always even hem is guaranteed. The hem at the posterior end of the cut off piece of material and the hem at the anterior end of the next part are being formed and secured at the same time.

The hemming elements being moved in transverse direction of the web may form a combination with sewing elements for fastening the hems. In order to rapidly secure the hems without interruptions, the process of securing same is preferably being carried out in that simultaneously with the cutting and hemming process, a strip of weldable material is included in the hems formed on either side, said strip being welded in the hems during the same process.

The device for carrying out the above-mentioned method comprises a supporting table for a web of fabric, driving elements for displacing said web of fabric longitudinally along said table, a number of scanners distributed across the width of the table and driving elements constituted by separate driving rollers or the like, each one of said rollers in longitudinal direction of the supporting table being in alignment with and at a distance from one of the scanners and each one being provided with a disconnecting device, said device being operated by the relative scanner. This device is also known from the aforementioned U.S. Pat. No. 2,716,266.

In accordance with the invention, the device is characterized by a carriage being transversely displaceable along the table, said carriage being provided with cutting and hemming elements which may operate in the same line of processing extending transversely to the table as the scanners.

The embodiments of the scanners may differ, depending on the characteristic of the web of fabric to be scanned. When, for example, a woven thread of a different colour has to be scanned, optical scanners may be used, which have been disposed at a distance above the line of processing. When, for example, a different height level has to be scanned, as is the case with one-piece woven bath-towels, in which each time an end strip has been provided without a pile between the separate towel-parts provided with a pile, it is preferred to use mechanical scanners. In order to prevent any interference with the passing of the cutting and hemming elements by the mechanical scanners, said scanners may operate the appertaining driving elements e.g. via a stationary retarding mechanism included in the electrical control, so that the area to be cut through will be stopped at a predetermined interval beyond the scanners. Said interval, however, should not be too long because otherwise with a flexible material transverse displacements may occur, which should be prevented. In this case, the line of operation of the cutting and hemming elements lies at a distance parallel to the line of operation of the scanning elements. It is also possible, however, to dispose the scanners in the same line of operation in which operate the cutting and hemming elements in that the scanning elements and, if required, also an opposed supporting surface co-operating with said scanning elements are movably disposed from the path of the cutting and hemming elements.

When the device is equipped for welding the hems, its carriage may comprise feeding elements for at least one strip of weldable material and the hemming elements are embodied such that they fold the cutting edge or edges of the web of fabric around the strip or each strip of weldable material and, in addition, the carriage comprises elements for welding the strip in the hem or in each hem thus being formed. In doing so, the strip is introduced when the hems are being formed.

The weldable strip is preferably used simultaneously for preventing fraying of the edges of the web of fabric which have been cut through and to this end the carriage comprises feeding elements for a strip of weldable material, as well as elements for adhering said strip across the width of the web of fabric, and the cutting elements for the web of fabric are constituted such that in cutting the web they also cut through the middle lengthwise the adhered strip of weldable material and the hemming elements for both cutting edges of the web of fabric are constituted such that they fold back the portion of the web provided with the adhered strip onto the adjoining part of said web, and the carriage comprises in addition means for the final welding of the stirp of weldable material onto the two adjoining layers of fabric in each hem thus being constituted. Since the material of the web of fabric has already been adhered to the strip of weldable material before the process of cutting, the web cannot fray during said cutting process and later-on.

In inserting the weldable strip, it is possible to weld the edges of a fabric of unweldable material, such as e.g. cotton, to each other. Since in many cases the scorching temperature of the fabric is about the same as the melting temperature of the weldable material, the elements for final welding of the hems preferably consist of ultrasonic welding elements. The ultrasonic waves will induce the melting of the weldable material so that said material will adhere strongly to the fibres of the two adjoining layers of e.g. cotton and they will, thus, unite said layers; in doing so, the layers of the fabric, such as cotton, are not heated intolerably because the ultrasonic wabves have almost no effect on them.

It is evident that if the web of fabric consists of a weldable material, the hems are weldable without the necessity of inserting a strip.

The parts of the hem which have been welded to each other either by welding a weldable web of fabric or by the insertion of a weldable strip into a fabric not being weldable itself will become harder by the welding process than the adjacent parts. In order to obtain a weak edge at the end products, the hemming elements are preferably constituted such that the welded strip lies at a distance from the outer edge of the web of fabric obtained after the process of folding.

It was found that a product welded in accordance with the invention can be washed at boiling temperature several times without the risk that the hems become undone or that the quality will deteriorate.

The invention will now be described more in detail with reference to the accompanying drawings, wherein.

Figure 1:
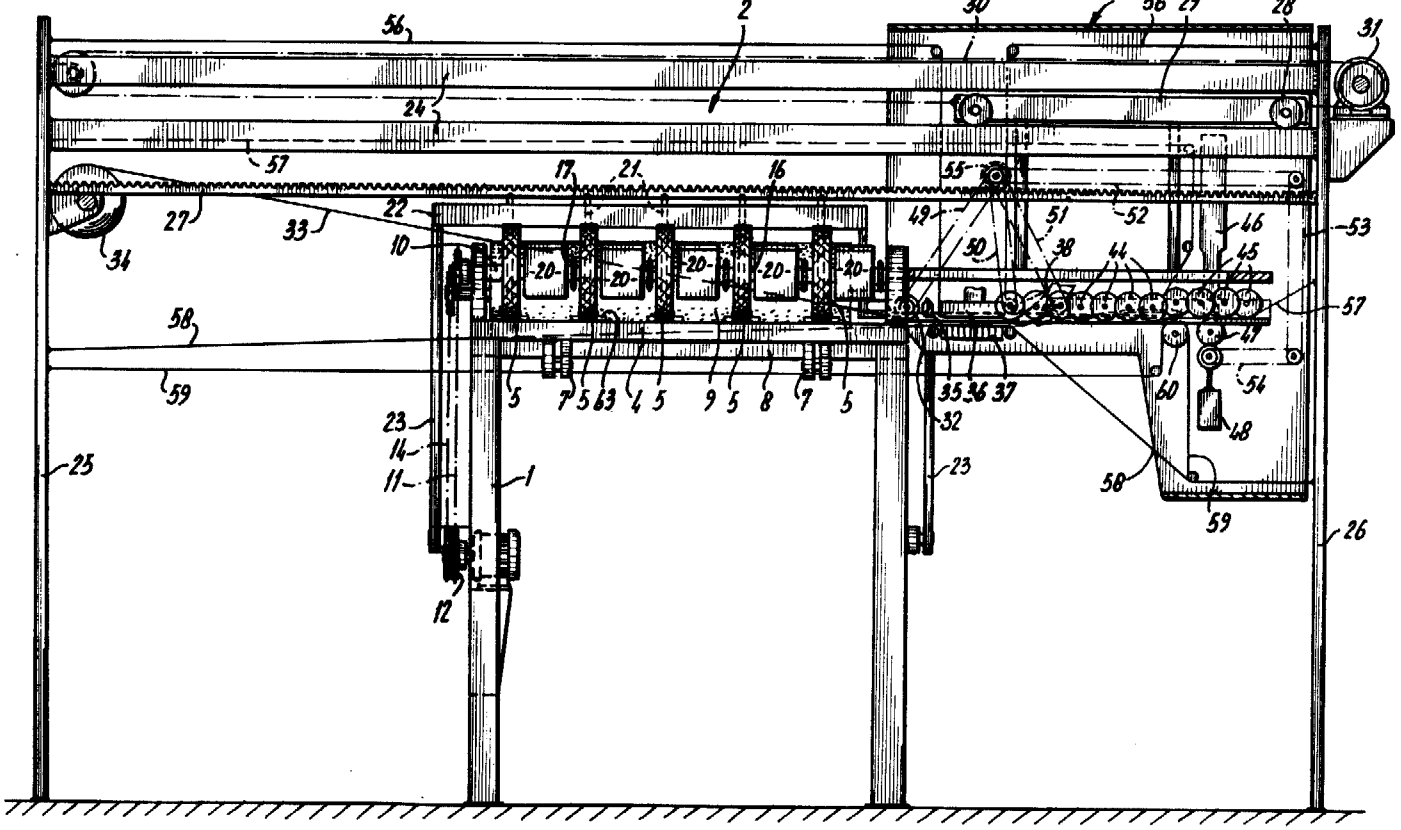
FIG. 1 is a front elevation of one embodiment of the device according to the invention.

In the illustrated embodiment the device comprises a supporting table 1 for a web of fabric, a bridge 2 extending transversely along said table and a carriage 3 is movable along said bridge 2. The leaf of table 1 shows a first portion 4 at the feed side of the bridge 2 and five driving elements 5 have been disposed above said portion 4 according to a common centre line extending transversely to the table, said driving rollers being described more in detail. Right next to said portion 4 the leaf of the table has a comparatively short part 6 extending below the bridge 2 and which swings down. To that end, part 6 is disposed at the free end of a set of arms 7, said arms being hinged below portion 4 of the table. Next to part 6 but slightly lower, the table leaf 1 has a final element or delivery portion 8 and a delivery roller 9, embodied as a brush and being driven, extends above said portion 8 transversely to the table 1.

A shaft 10 extends transversely to the table above its portion 4, at a region between the driving rollers 5 and the bridge 2. Via a chain drive 11, the shaft 10 is constantly being driven from a driving wheel 12 located below the table. The driving brush 9 on portion 8 of the table is also being driven constantly from the driving wheel 12 via chain drives 13 and 14. Five hinged arms 15 are mounted side by side on the shaft 10 and a housing 20 is secured below the free end of each arm 15, said housing comprising an electrically operated clutch-brake-unit, known as such. A shaft 16 extends on either side of each housing 20, said shaft at its one end carrying one of the driving rollers 5 and at its other end a chain wheel 17. A chain 18 is being guided over said chain wheel 17, said chain passing also over a chain wheel 19 disposed on the shaft 10. The individual driving rollers 5 are, thus, being driven constantly and independently from each other as long as the clutch is being engaged in the appertaining housing 20, and they may be locked independently for a purpose to be described more in detail by applying the brake in the appertaining housing 20. Each driving roller 5 rests with its own weight with reciprocating movement on portion 4 of the table and the cloth moving thereon respectively, so that the five driving rollers 5 may adapt themselves independently to irregularities of the cloth moving along below them.

Five scanners 21 rest on the swing-away part 6 of the table 1 according to a common line of operation A extending transversely to the table, said scanners being secured to a common supporting beam 22. Seen in longitudinal direction of the table, each scanner 21 is in line with one of the driving rollers 5 (see FIG. 3). The common supporting beam 22 of the scanners extending transversely to the table is secured to the free end of a pair of supporting arms 23 being hinged below the table 1 in such a way that the supporting beam 22 and the scanners 21 can be moved out of the path of the carriage 3 (see FIG. 2). Each scanner 21 is individually movable in vertical direction under the influence of the differences in height level of the cloth moving along below said scanner, in which the scanner may close an electric contact which controls the clutch-brake-unit 20 of the driving roller 5 being in line therewith. Said electric contact is set such that disengages the clutch of the unit 20 and the brake is applied simultaneously when the scanner 21 descends below a specific minimum height.

Figure 3:
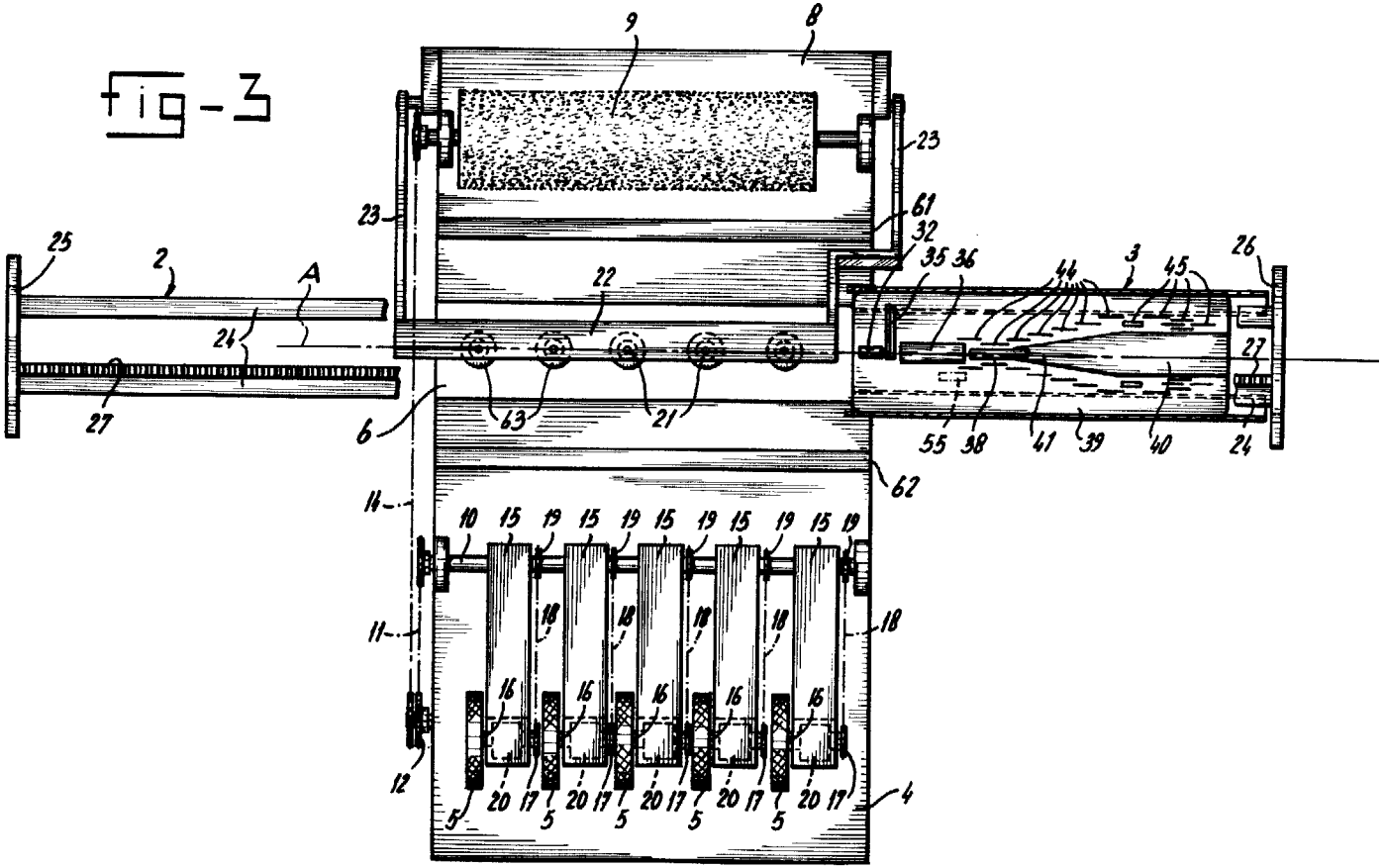
FIG. 3 is a top elevation of the device according to FIG. 1.
Figure 4:
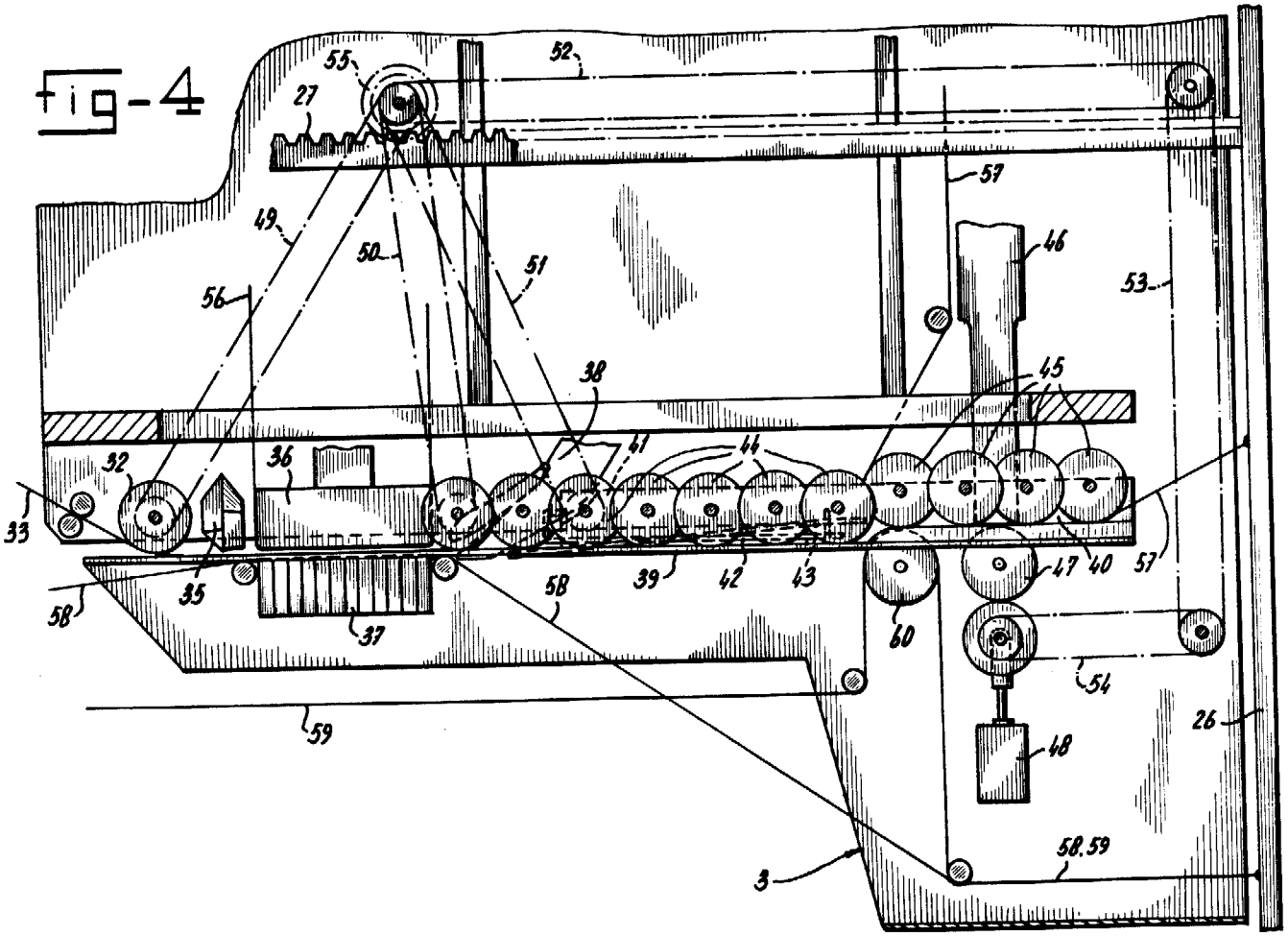
FIG. 4 is an elevation of a detail of the device according to FIG. 1.

As has been stated before, the bridge 2 extends transversely to the table, above part 6 thereof. Said bridge 2 comprises four carrier bars 24 extending between columns 25, 26 on either side of the table 1. A rack bar 27 extends between said columns 25, 26 below the carrier bars 24. A supporting frame 29 of the carriage 3 provided with travelling wheels 28 may run along the carrier bars 24 and is being pulled forward and backward thereon by a chain 30, said chain being driven by an electromotor 31. The supporting arms 7 and 23, being also electrically operational, of the swing-away part 6 of the table and of the supporting beam 22 of the row of scanners 21 respectively, are connected to the circuit of the electromotor 31 in such a way that each time the arms 7 and 23 first swing away part 6 of the table and the scanners 21 are moved out of the path of the carriage 3 before the electromotor 31 pulls the carriage 3 forward and backward along the bridge 2. Being inoperative, the carriage 3 is disposed at the right side of the table 1 (see FIG. 1). At the level of the upper surface of part 6 of the table 1 the carriage 3 comprises from left to right a number of processing devices disposed one behind the other, which are illustrated at a larger scale in FIG. 4. At the left side of the carriage 3, at the upper side of the working surface, a guide roller 32 has been provided for a strip 33 of a weldable material such as polyamide, said strip having a width of approximately 8 mm and being drawn from a delivery spool 34, said spool being rotatably secured to the left column 25 of the bridge 2. Right next to the guide roller 32 at the right side an electrically operated scissors 35 is disposed for transversely cutting the strip 33. An electrically heated welding head 36 is disposed at the right side of the scissors 35, said welding head may rest on the upper side of the cloth and co-operates with a row of laminae 37 disposed at the underside of the working surface and facing said surface. A pair of mechanically operated scissors 38 is disposed right next to the welding head 36 at the right side, said scissors may cut the fabric and the strip welded thereon according to a line of operation extending transversely to the table 1 so that the strip 33 is cut through the middle lengthwise. A bearer plate 39 for the cloth extends in the carriage 3 at the same level as the upper surface of table 1, said plate at the region of the welding head 36 and the scissors 35 and 38 being provided with a recess. The right part of the bearer plate 39 is provided with a flat elevation 40 of a constant level, said elevation 40 terminating at its left side in a V-shaped end portion 41 (see FIG. 3). The V-shaped end portion 41 of the flat elevation 40 terminates right next to the scissors 38 at the right side. A pair of foldable rods 42, 43 extend on either side of the V-shaped end portion 41; rod 42 is directed almost parallel to the sides of the V-shaped end portion 41, whereas rod 43 is curled around said end portion such that the cloth edge running between rods 42 and 43 is being folded. A row of wheels 44 is disposed in V-shape on either side of the V-shaped end portion 41 on the understanding that the wheels 44 are directed parallel to the line of operation of the carriage 3 but that the connecting line of their centres runs parallel to the sides of the V-shaped end portion 41. Next to the right portion of the elevation 40 connecting to the V-shaped end porton 41 are other wheels 45 being arranged one behind the other in a straight line parallel to the line of operation of the carriage 3. An ultrasonic welding head 46 is disposed on either side of the straight part of the elevation 40 and a wheel 47 is disposed below the working surface on either side of the elevation 40, opposite to the welding head 46, said wheel may be pressed from below against the cloth by a magnet coil 48. The bearer plate 39 has a shallow elevation with recesses accommodating the top of the wheels 47. At the front of said elevation, the top of a non-driven wheel 60 is accommodated in a recess, said wheel guiding the cloth up to the elevation.

The drive of the guide roller 32, the scissors 38 and the wheels 44, 45 and 47 occurs via chains 49, 50, 51, 52, 53 and 54; all chains are being driven from a common axis supported in the carriage 3, said axis carrying in addition a toothed wheel 55 which rolls along the rack bar 27 when the carriage 3 is being moved along bridge 2. A fully synchronous drive of said parts is, thus, guaranteed.

In order to improve the sliding of the cloth over and below the various processing devices, a number of slibbands 56, 57, 58 and 59 has been stretched between the supporting columns 25 and 26 of the bridge 2 and guided over guide rollers in the carriage 3 in such a way that the extend at certain distances above and below the processing devices. Band 56 is guided below the heated welding head 36. The pair of bands 57 is guided on either side of elevation 40 below the ultrasonic welding head 46. Band 58 is carried over laminae 37. The pair of bands 59 is carried over guide rollers 60. The ends of the slibbands are firmly secured to columns 25 and 26 and they unroll along guide rollers disposed in the carriage 3 when said carriage is being moved along. In this embodiment, bands 56, 57, 58 and 59 preferably consist of metal, such as brass tape but for some of the bands a synthetic, such as Teflon, can be used as well.

It is primarily the object of this invention to cut in transverse direction and simultaneously hem a continuous web of fabric, said web comprising sections with a pile, separated by narrow strips without a pile, such as one-piece woven bath towels. In this case the device operates as follows:

The web of fabric is fed from the right to the left (see FIG. 2) on portion 4 of the table 1. The five driving rollers 5 equally distributed across the width of the table and rotating with the same speed feed the cloth evenly till below the scanners 21. Because of the nature of the cloth, however, it cannot be avoided that across the width of the cloth slight differences occur in movement as a consequence of which the various parts of the width of the cloth will not arrive below the five scanners 21 at the same time. Said scanners are equipped such that they will perform the function of engaging when the strip, extending transversely to the cloth and not provided with a pile (thus being lower), passes beneath the scanner. When on a certain part of the width of the cloth said lower strip arrives beneath a scanner, said scanner will disengage the driving roller 5 being longitudinally in line with said scanner and lock the brake of said driving roller simultaneously. The adjacent parts of the cloth will move on until also there the strip without a pile has arrived below the scanner. When all scanners (five) have disengaged the five appertaining driving rollers, the cloth has come to rest in such a way that the strip without a pile stretches across the full width of the cloth beneath the scanners.

It should be noted that in fitting a new web of fabric, the first pile-section, e.g. the first towel, should first be passed beneath the row of scanners and below the brushed-shaped drive roller 9 disposed at the delivery side before the first process is carried out along the back edge of said first cloth section. As the circumferential speed of the brush-shaped roller 9 is a few percentages higher than the circumferential speed of the driving rollers 5, the cloth is constantly kept taut during the movement beneath the scanners 21 and one can be sure that a cloth having been finished at its back edge has already been delivered by the brush-shaped roller 9 before the new cloth section, which has still to be processed at its back edge, will arrive below the brush-roller 9.

Figure 2:
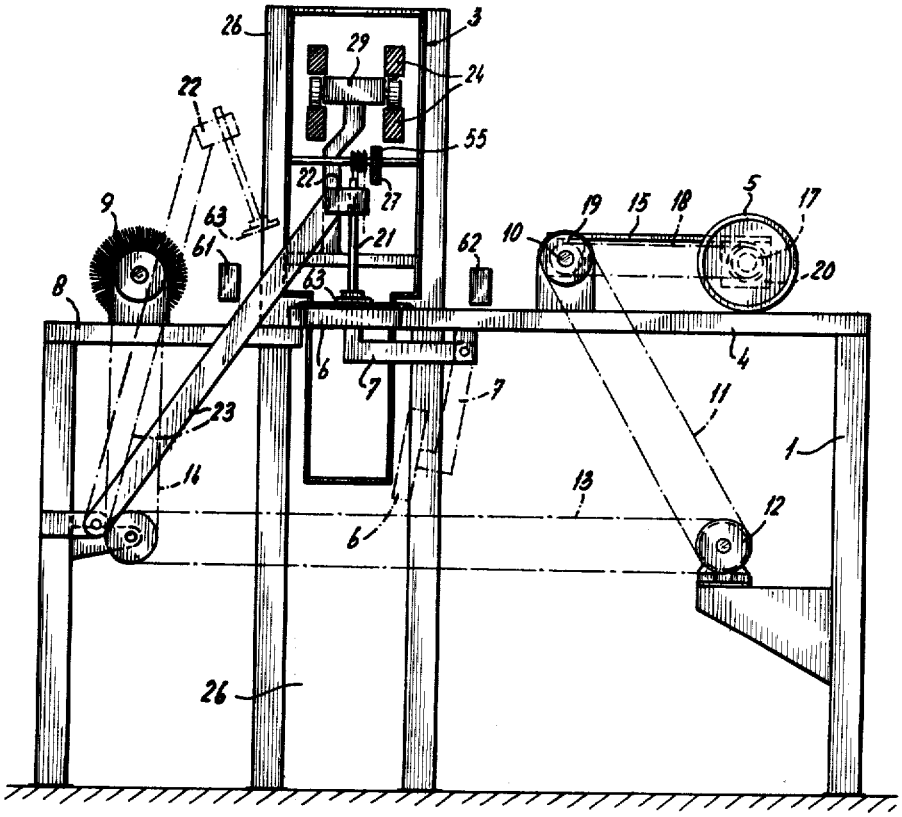
FIG. 2 is a side elevation of the device according to FIG. 1.

When the strip, not provided with a pile, has been stopped below the scanners 21, arms 7 and 23 will move part 6 of the table and the scanners 21 out of the path of the carriage 3 (illustrated in dotted lines in FIG. 2). The motor 31 will then pull carriage 3 via the chain 30 from the right to the left side (see FIG. 1 and 3) along bridge 2, whereby the toothed wheel 55 will roll along the rack bar 27 so that the processing devices such as roller 32, scissors 38 and wheels 44, 45 and 47 are being driven. In doing so, the processing devices are moved along the same line A which was scanned beforehand by the scanners 21. Thus, no shifting of the cloth can occur. If required, the cloth can be clamped by clamping strips, indicated by reference numerals 61 and 62 (see FIG. 2), which from above press the cloth against the table.

As soon as the driven roller 32 has reached the right side of the cloth, the strip 33 of the weldable material lying beneath said roller will be clamped between the cloth and roller 32 and when roller 32 is being rolled along as a consequence of the movement of the carriage 3, said roller will place the strip 33 from the right to the left side across the width of the cloth. Immediately thereafter the strip is being heated by the welding head 36 gliding over said strip such that the strip adheres slightly to the cloth. Thereupon, the scissors 38 being driven continuously will cut the cloth across the width, according to the line of operation of the carriage 3, in which the strip 33 is simultaneously cut through the middle lengthwise so that a strip of about 4 mm of weldable material is adhered to each one of the two resulting cloth edges. Subsequently, the two cloth edges thus being constituted will be folded by the rods 42 and 43 and simultaneously pressed outwards by the V-shaped portion of the elevation 40, as a result of which folded edges are constituted at both ends of the cloth, said edges being preferably larger than the weldable strip extending along the extreme edge of the cloth. One can thus be sure that the sides of the constituted hems are soft. Wheels 44 will then convey the folded edges on both ends of the cloth till near the ultrasonic welding head 46 and wheels 45 will then convey said edges beneath the welding head. In doing so, the weldable strips included in the two folded edges are melted together by the ultrasonic influence with the non-weldable parts, of, e.g. cotton, extending above and below, of the folded edges of the cloth, so that a permanent hem is being formed at the front end and the back end of the cloth.

Before the ultrasonic welding head 46 reaches the right side of the cloth, magnet coil 48 keeps the pressure roller 47, disposed below the welding head 46, at a distance below the working surface. It is only after the welding head 46 has arrived above the cloth that the pressure roller 47 is raised in order to press the cloth against the welding head. The cloth is, thus, prevented from turning up. When the carriage 3 is moved along, the slibbands 56, 57, 58 and 59 stretching between the supporting columns 25 and 26 are pulled above and below the various processing devices respectively, as a result of which the gliding of said processing devices over the cloth is stimulated and the turning up of same is prevented.

When the front of the carriage 3 reaches the left side of the cloth, scissors 35 cuts the strip of weldable material 33 and the carriage 3 will then continue until it has reached the extreme left side of the cloth; subsequently, by reversing the direction of rotation of the motor 31, the carriage is pulled back along the bridge 2 and stopped, the clamping strips 61 and 62 are lifted, the brush-shaped roller 9 discharges the cloth lying at the left side of bridge 2 (see FIG. 2), the part 6 of the table and the scanners 21 are brought back into the operating position, the driving rollers 5 are re-engaged and the process may be repeated.

In the illustrated embodiment, the scanners 21 are provided with disc-shaped sliding feet 63 for properly gliding over the pile. Said sliding feet fit the strip without a pile of the web of fabric to be scanned. However, other embodiments of the device are also possible. The scanners 21 may be shaped differently and be equipped for engaging when the cloth has a different characteristic other than having no pile. It is also possible to replace certain operations carried out by the carriage 3 by other ones. In addition, the magnet coil 48 may be replaced by an air cylinder and, e.g. the chains 49, 50, 51, 52, 53 and 54 may be replaced by toothed belts.

It is remarkable that all operations, such as the directing of the cloth, the cutting, folding and welding are carried out in the same place and, consequently, no intermediate transportation is required, which might cause a shifting of the cloth. Another aspect is that the directing of the cloth takes place fully automatically by scanning the pile height. Still another aspect is that sewing is omitted and replaced by the more simple and more reliable process of welding the hem. In doing so, the hem of a not weldable material, such as cotton, is secured by ultrasonic melting together a strip of weldable material accommodated in the hem with the cloth, whereby the cloth as such is not being heated. During and after the cutting of the cloth, the weldable strip adhered thereto prevents fraying of the edges. Although a strip of weldable material, such as polyamide, is melted in the hems of the cloth, the edge thus obtained is not hard if the width of the hem is chosen such that the weldable strip lies at a distance of a few millimeters from the final hem edge. The hem thus being formed proves to be very durable.

We claim:

1. A method for transversely cutting and hemming a web of fabric including the steps of moving said web along a longitudinal direction, scanning the region where the web must be cut through with the aid of a number of scanners disposed along a line A perpendicular to the direction of movement of the web, automatically stopping said web each time each scanner interrupts the drive of the corresponding part of the width of the web, and, finally, setting the web in motion again, and said method further comprising the steps of transversely cutting and hemming said web, the improvement wherein steps of cutting and hemming said web of fabric comprises moving cutting elements and hemming elements along said line A in a transverse direction of said web during web stoppage for cutting said web and for hemming the edges being cut.

2. Method according to claim 1, wherein said steps of transversely cutting and hemming said web of fabric comprises simultaneously including a strip of weldable material in the hems formed on either side of said cutting element and welding said strip in the hems.

3. Method according to claim 2, wherein said steps of transversely cutting and hemming said web of fabric comprise adhering slightly a strip of weldable material across the width of fabric, cutting said web through the middle of the slightly adhered strip, folding over the two edges accommodating the weldable strip and welding said folded over edges and the accommodated strip portion in the hems.

* * * * *